United States Patent [19]

Alexander

[11] 4,161,082

[45] Jul. 17, 1979

[54] FIGURE TOY LIMB WITH TWIRLING HAND UNIT

[76] Inventor: Brian S. Alexander, 907-1# Austin, Evanston, Ill. 60202

[21] Appl. No.: 855,160

[22] Filed: Nov. 28, 1977

[51] Int. Cl.[2] ..... A63H 7/00; A63H 3/46

[52] U.S. Cl. ..... 46/119; 46/163

[58] Field of Search ..... 46/116, 118, 119, 153, 46/163, 164, 264, 265, 266

[56] References Cited

U.S. PATENT DOCUMENTS

| | | | |
|---|---|---|---|
| 1,507,657 | 9/1924 | Benoist | 46/119 X |
| 1,610,724 | 12/1926 | Wilson | 46/153 |
| 1,776,964 | 9/1930 | Aznak et al. | 46/119 X |
| 2,514,356 | 7/1950 | Borresen | 46/119 |
| 2,623,329 | 12/1952 | DiLeva | 46/163 X |
| 2,733,545 | 2/1956 | Guadagna | 46/163 X |
| 3,100,949 | 8/1963 | Brenneman | 46/265 X |
| 4,047,325 | 9/1977 | Yamazaki | 46/116 X |

*Primary Examiner*—F. Barry Shay

[57] ABSTRACT

A figure toy limb comprised of a hollow arm portion incorporating multiple supporting standards to hold and allow for the rotation of a remotely operated twirling hand unit composed of an axle having a figure toy hand securably attached at one end and a cylindrical turning wheel securably attached a small distance away from the other end so that rotating the cylindrical turning wheel (by finger) will impart a twirling motion to the figure toy hand especially useful when an accessory such as a baton is attached to the figure toy hand.

3 Claims, 16 Drawing Figures

FIGURE TOY LIMB WITH TWIRLING HAND UNIT

DESCRIPTION OF THE PREFERRED EMBODIMENT

Figure 1:
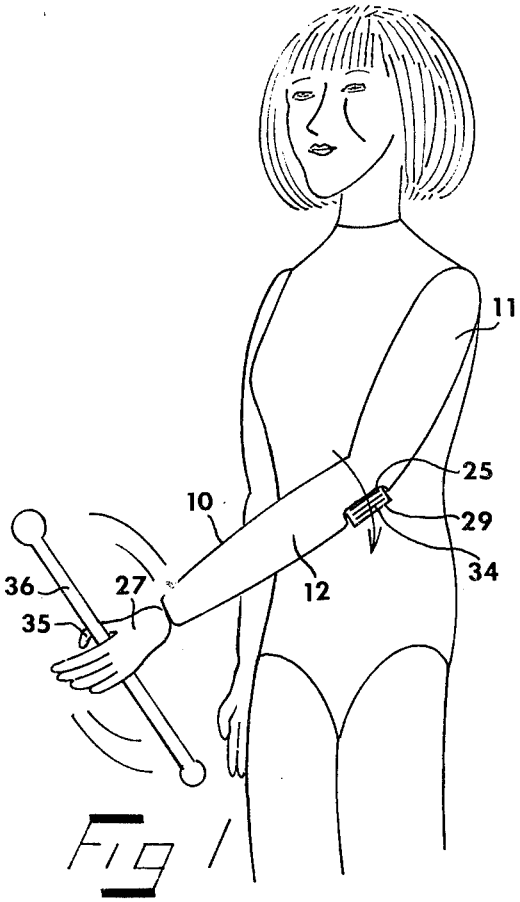
FIG. 1 is a perspective view of the figure toy limb attached to a figure toy.
Figure 2:
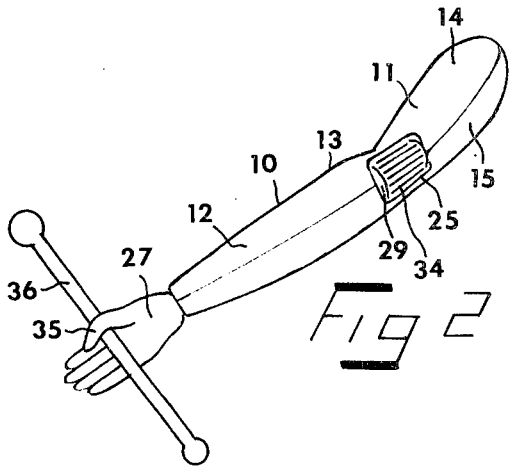
FIG. 2 is a perspective view of the underside of an assembled figure toy limb when made with a two part arm section.
Figure 3:
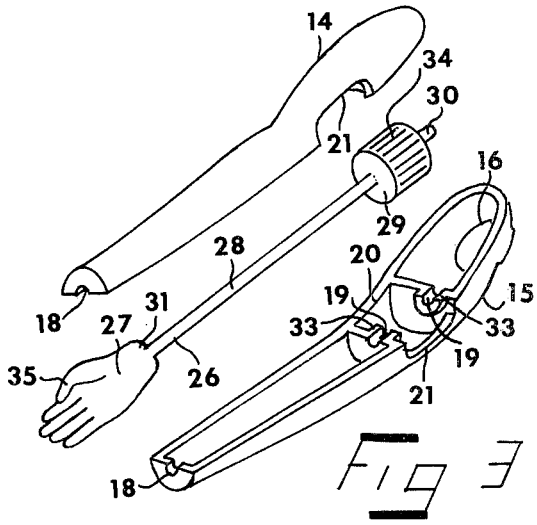
FIG. 3 is an exploded perspective view of the underside of the figure toy limb when made with a two part arm section and a one piece remotely operated twirling hand unit.
Figure 4:
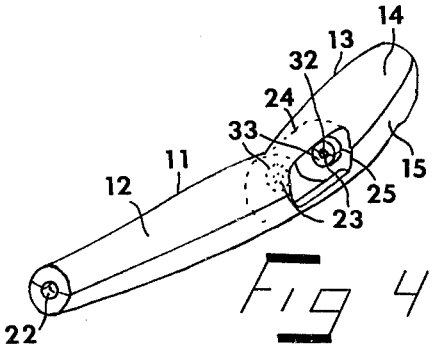
FIG. 4 is a perspective view of the two part arm section in assembled condition without the remotely operated twirling hand unit (for purposes of illustration).
Figure 5:
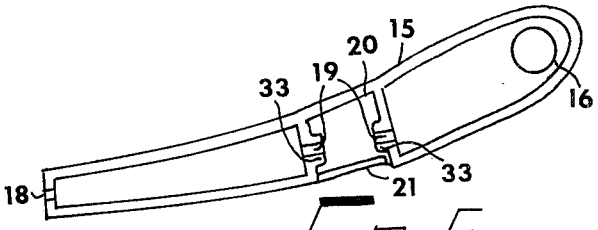
FIG. 5 is a side view of the posterior side arm part of the two part arm section.
Figure 6:
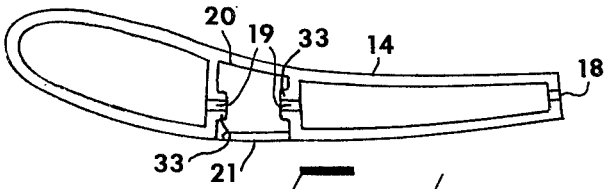
FIG. 6 is a side view of the anterior side arm part of the two part arm section.
Figure 7:
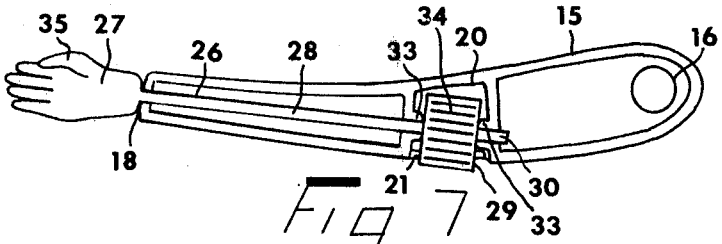
FIG. 7 is a side view of the posterior side arm part combined with a one piece remotely operated twirling hand unit.
Figure 8:
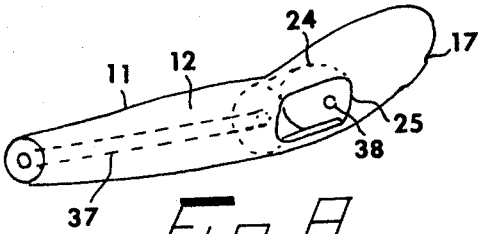
FIG. 8 is a perspective view of a one piece arm section.
Figure 9:
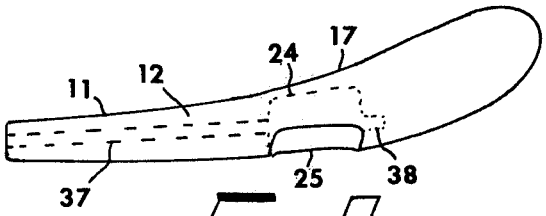
FIG. 9 is a side view of a one piece arm section.
Figure 10:
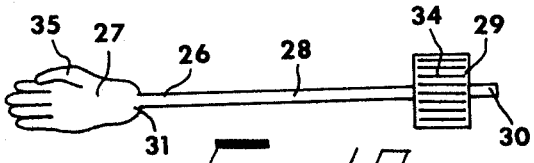
FIG. 10 is a side view of a one piece remotely operated twirling hand unit.
Figure 12:
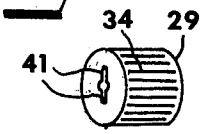
FIG. 12 is a perspective view of a cylindrical turning wheel including interlocking slots.
Figure 11:
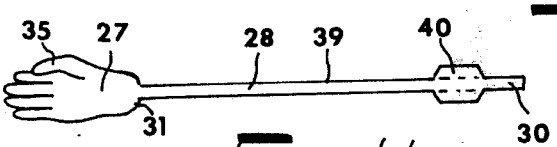
FIG. 11 is a side view of a hand and axle part having a fluted retainer section.
Figure 13:
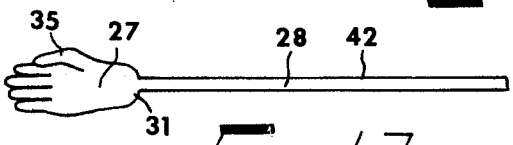
FIG. 13 is a side view of a hand and straight axle part.
Figure 14:
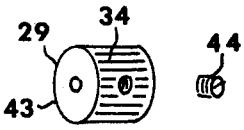
FIG. 14 is a perspective view of a screw adapted cylindrical turning wheel and a screw.
Figure 15:
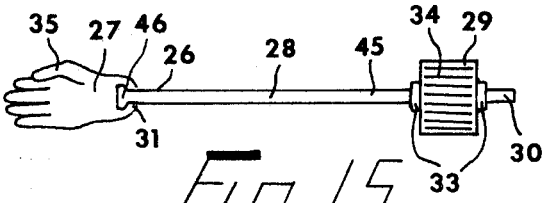
FIG. 15 is a side view of a cylindrical turning wheel and axle unit having optional extending portions with a separate figure toy hand unit attached at the end.
Figure 16:
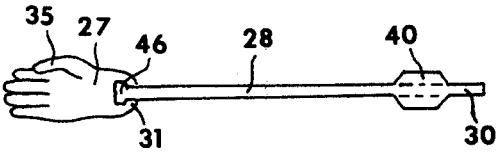
FIG. 16 is a side view of an axle with fluted retainer section having a separate figure toy hand attached at the end.

A figure toy limb 10 has an arm section 11 made of rigid or semi-rigid material where the arm section 11 or only the forearm portion 12 of the arm section 11 is essentially hollow and where the arm section 11 can be made either as a two part arm section 13 with an anterior side arm part 14 and a posterior side arm part 15 (as in FIGS. 2–7) or as a one piece arm section 17 (as in FIG. 8 and FIG. 9). In the embodiment of the two part arm section 13 both the anterior side arm part 14 and the posterior side arm part 15 incorporate a distal supporting standard section 18, two chamber wall supporting standard sections 19, a cylindrical chamber section 20, and a cylindrical chamber opening section 21 so that when the anterior side arm part 14 is combined with the posterior side arm part 15 a distal supporting standard 22, two chamber wall supporting standards 23, a cylindrical chamber 24, and a cylindrical chamber opening 25 are formed. The distal supporting standard 22, and two chamber wall supporting standards 23 hold and allow for the rotation of a remotely operated twirling hand unit 26 composed of a toy figure hand 27 which is a part of or attached to a straight shafted axle 28 approximately the length of the forearm portion 12 of the arm section 11. The axle 28 is a part of or attached to a cylindrical turning wheel 29 which has a smaller diameter than the cylindrical chamber 24 and which is located a small distance from the end of the axle 28 so that a small axle section 30 extends beyond the cylindrical turning wheel 29. The remotely operated twirling hand unit 26 combines with the two part arm section 13 so that the distal supporting standard 22 is adjacent to the figure toy hand end 31 and so that the cylindrical turning wheel 29 fits almost completely inside and is easily rotated in the cylindrical chamber 24 with one chamber wall supporting standard 23 on each side of the cylindrical turning wheel 29 and where the small axle section 30 fits into and is easily rotated in the outer chamber wall supporting standard 32. The two chamber wall supporting standards 23 could include small extending portions 33 that would extend within the area of the cylindrical chamber 24 or extending portions 33 could be incorporated into the axle 28 or cylindrical turning wheel 29 parts of the remotely operated twirling hand unit 26. In either case, the purpose of the extending portions 33 would be to allow for less friction between movement of the cylindrical turning wheel 29 and the wall of the cylindrical chamber 24 during rotation. The cylindrical chamber opening 25 is large enough and the centers of the cylindrical chamber 24 and the cylindrical turning wheel 29 are not aligned so that a portion of the cylindrical turning wheel 29 extends beyond the surface plane of the cylindrical chamber opening 25 and that finger motion against the grooved cylindrical turning wheel surface 34 can easily impart rotation of the cylindrical turning wheel 29 and subsequently impart rotation of the axle 28 and toy figure hand 27 which is a part of or connected to the cylindrical turning wheel 29. The toy figure hand 27 has a clinched thumb 35 for securing accessories such as a baton 36. Thus by spinning the cylindrical turning wheel 29 (by finger) the toy figure hand 27 will twirl and simulate the action of twirling a baton 36 or other object affixed to the clinched thumb 35. In the one piece embodiment of the arm section 11, the one piece arm section 17 (FIG. 8 and FIG. 9) the function of the distal supporting standard 22 and one chamber wall supporting standard 23 could be achieved by a hollow cylindrical channel 37. The outer chamber wall supporting standard 32 would be a cylindrical hole 38. The cylindrical chamber 24, chamber opening 25, and extending portions 33 would work in relation to the remotely operated twirling hand unit 26 in the same manner described for the embodiment of the two part arm section 13. The remotely operated twirling hand unit 26 can be made with various modifications. FIG. 10 shows a one piece remotely operated twirling hand unit 26. FIG. 11 shows one piece of a two piece remotely operated twirling hand unit 26 having a hand and axle part 39 where the axle 28 has a fluted retainer section 40. The fluted retainer section 40 would interlock into a cylindrical turning wheel 29 having slots 41 to provide a tight fit as in FIG. 12. FIG. 13 shows one part of a two piece remotely operated twirling hand unit 26 having a hand and straight axle part 42 where the axle 28 is a straight rod. This hand and straight axle part 42 would interlock with a screw adapted cylindrical turning wheel 43 (FIG. 14) where a screw 44 tightly connects the screw adapted cylindrical turning wheel 43 to the hand and straight axle part 42. FIG. 15 shows a two piece remotely operated twirling hand unit 26 having a cylindrical turning wheel and axle unit 45 with optional extending portions 33. The cylindrical turning wheel and axle unit 45 would attach to a separate figure toy hand 27 preferably by molding the figure toy hand 27 on the axle end 46. FIG. 16 shows two parts of a three piece remotely operated twirling hand unit 26 having an axle 28 and fluted retainer section 40. The fluted retainer section 40 would interlock into a cylindrical turning wheel 29 having slots 41 to provide a tight fit as in FIG. 12. The axle end 46 would attach to a separate figure toy hand 27 preferably by molding the figure toy hand 27 on the axle end 46. The forms of the remotely operated twirling hand unit 26 shown in FIG. 13, FIG. 15, and FIG. 16 could be used with a one piece arm section 17. Any of these or the forms shown in FIG. 10 and FIG. 11 could be used with a two part arm section 13.

While this invention has been shown and described in the best forms known, it will nevertheless be understood that these are purely exemplary and that modifications may be made without departing from the spirit of the invention.

I claim:

1. A figure toy limb comprising, in combination, an arm having a hollow portion, multiple supporting standards within said hollow portion, an outer chamber opening in the wall of said hollow portion, a twirling hand unit held by said arm portion, said twirling hand unit including an axle mounted on said standards and easily rotatable thereon, a figure toy hand non-rotatably attached at one end of said axle and a cylindrical turning wheel non-rotatably attached near or at the other end of said axle, part of the said cylindrical turning wheel being accessible through the said outer chamber opening so that rotating the said cylindrical turning wheel (by finger) will impart a twirling motion to the said figure toy hand.

2. The combination according to claim 1 wherein the said hollow arm portion is made of two half sections joined together.

3. The combination according to claim 1 wherein the said hollow arm portion is made in one piece.

* * * * *